US009759530B2

(12) United States Patent
Miller

(10) Patent No.: US 9,759,530 B2
(45) Date of Patent: Sep. 12, 2017

(54) TARGET IMPACT SENSOR TRANSMITTER RECEIVER SYSTEM

(71) Applicant: Brian D. Miller, Louisville, KY (US)

(72) Inventor: Brian D. Miller, Louisville, KY (US)

( * ) Notice: Subject to any disclaimer, the term of this patent is extended or adjusted under 35 U.S.C. 154(b) by 0 days.

(21) Appl. No.: 14/544,922

(22) Filed: Mar. 6, 2015

(65) Prior Publication Data

US 2015/0330749 A1 Nov. 19, 2015

Related U.S. Application Data

(60) Provisional application No. 61/966,937, filed on Mar. 6, 2014.

(51) Int. Cl.
*G08B 1/08* (2006.01)
*F41J 5/14* (2006.01)

(52) U.S. Cl.
CPC ..... *F41J 5/14* (2013.01)

(58) Field of Classification Search
CPC combination set(s) only.
See application file for complete search history.

(56) References Cited

U.S. PATENT DOCUMENTS 3,678,495 A 7/1972 Gilbert
3,849,910 A * 11/1974 Greenly ..... F41G 3/2694 273/358
4,340,370 A * 7/1982 Marshall ..... F41G 3/2661 273/368
4,351,026 A 9/1982 Phillips
4,514,621 A 4/1985 Knight et al.
4,885,725 A 12/1989 McCarthy et al.
5,095,433 A * 3/1992 Botarelli ..... F41J 5/056 235/400
5,195,752 A * 3/1993 Reeves ..... F41J 5/04 2/102
5,320,362 A * 6/1994 Bear ..... A63F 9/0291 273/445
5,447,315 A * 9/1995 Perkins ..... F41J 5/056 273/348
5,551,876 A 9/1996 Koresawa et al.
5,676,548 A 10/1997 McAlpin et al.
5,823,779 A 10/1998 Muehle
5,944,317 A 8/1999 Rohrbaugh
6,109,614 A 8/2000 Ciarcia
6,196,844 B1 3/2001 Bradshaw
6,322,365 B1 11/2001 Schecter et al.
6,367,800 B1 4/2002 Sheck et al.
6,616,452 B2 9/2003 Clark et al.
7,329,127 B2 2/2008 Kendir et al.
7,685,862 B1 3/2010 Hughes et al.

(Continued)

*Primary Examiner* — Travis Hunnings
(74) *Attorney, Agent, or Firm* — Carrithers Law Office, PLLC

(57) ABSTRACT

A system for sensing the impact of a bullet on a target and remotely reporting the successful impact to the shooter by means of a signal transmitted from a sensor transmitter to a receiver incorporated with headphones, ear buds or an I-phone with Bluetooth capability. The sensor includes a wireless transmitter and a impact/vibration sensor such as a piezoelectric sensor. The target impact sensors can be used with various stationary targets such as metallic or paper targets, but can also be used on movable targets such as body armor worn by players in paint ball competition.

3 Claims, 8 Drawing Sheets

(56) References Cited

U.S. PATENT DOCUMENTS

| | | | | |
|---|---|---|---|---|
| 7,891,231 | B2 | 2/2011 | Song | |
| 8,336,776 | B2 | 12/2012 | Horvath et al. | |
| 8,356,818 | B2 | 1/2013 | Mraz | |
| 8,360,776 | B2 | 1/2013 | Manard et al. | |
| 8,453,368 | B2 | 6/2013 | Bockmon | |
| 8,523,185 | B1 * | 9/2013 | Gilbreath | F41J 5/056 273/348 |
| 8,561,993 | B2 | 10/2013 | Preston et al. | |
| 8,668,496 | B2 | 3/2014 | Nolen | |
| 8,672,756 | B2 | 3/2014 | Segal et al. | |
| 8,706,440 | B2 | 4/2014 | McNelis et al. | |
| 2003/0082502 | A1 | 5/2003 | Stender et al. | |
| 2003/0134700 | A1 | 7/2003 | Salva | |
| 2008/0066362 | A1 | 3/2008 | Fidlow | |
| 2010/0093255 | A1 | 4/2010 | Yamamoto | |
| 2010/0301116 | A1 | 12/2010 | Bennetts et al. | |
| 2011/0248448 | A1 | 10/2011 | Hodge | |
| 2012/0183930 | A1 | 7/2012 | Dribben | |
| 2012/0258432 | A1 | 10/2012 | Weissler | |
| 2013/0193645 | A1 | 8/2013 | Kazakova et al. | |
| 2013/0288205 | A1 | 10/2013 | Lupher et al. | |
| 2013/0337415 | A1 | 12/2013 | Huet | |
| 2013/0344461 | A1 | 12/2013 | Tello | |
| 2014/0038136 | A1 | 2/2014 | Hamilton | |
| 2014/0090629 | A1 | 4/2014 | Pedersen | |
| 2014/0367918 | A1 * | 12/2014 | Mason | F41J 5/04 273/371 |

* cited by examiner

TARGET IMPACT SENSOR TRANSMITTER RECEIVER SYSTEM

CROSS REFERENCES TO RELATED APPLICATIONS

This application claims priority from U.S. Provisional Application Ser. No. 61/966,937 filed on Mar. 6, 2014 and is hereby incorporated by reference herein.

TECHNICAL FIELD

The present invention relates to the field of systems used to sense and report the impact of a bullet or other projectile upon a distant target especially when such impact is too small to be detected either visually or by sound.

BACKGROUND OF THE INVENTION

A BB gun, pellet gun, air soft rifle, rifle, crossbow, bow and arrow or other device for shooting projectiles is often used for target practice. When the projectile hits a metal target there is only a modest ping sound from a BB or 22, or no detectible sound from a pellet rifle such as is used in competition. Air soft guns are replica guns which use non-lethal ammunition such as plastic pellets, paper balls, and eraser chunks.

During target practice, it is desirable that a target is not consumed or ruined by a few hits. Otherwise the target must be renewed frequently. Paper bull's eye type targets are well known but are useable for only a few hits and must be scored from a vantage point nearer than the shooting position. This fact renders paper targets as undesirable. Metal targets such as shown in FIG. 3 are available in various sizes. Some are designed to flip up out of the way when hit but then must be lowered back to the shooting position. Some are provided with a top target which, when hit, resets the rest of the targets. Still, such metal targets don't give the desirable audible report.

Paint ball competition, a game wherein shooters use guns which shoot small plastic paint balls filled with paint, at one another, has become very popular. The balls rupture when they impact the target, and thus, the target is marked visibly by the paint as a hit. Sometimes, competition is done in dark areas. This can make a hit harder to see. Because competitors wear protective equipment, it is often not obvious who was hit.

DESCRIPTION OF THE RELATED ART

U.S. Pat. No. 5,095,433 by Botarelli et al for TARGET REPORTING SYSTEM which issued on Mar. 10, 1992 teaches a target with a plurality of sensors connected to a controller which transmits a message to a receiver with a loudspeaker to inform the shooter approximately where his hit occurred and is incorporated by reference herein.

U.S. Pat. No. 7,891,231 by Song for APPARATUS FOR MONITORING AND REGISTERING THE LOCATION AND INTENSITY OF IMPACTS IN SPORTS which issued on Feb. 22, 2011 teaches a garment such a vest with pads spaced out over the vest, each pad containing an impact sensor. The sensors wirelessly transmit impact data to a receiver for registering and display of the data. The impacts result from opponents landing blows during boxing, martial arts, fencing and the like.

U.S. Pat. No. 8,356,818 by Mraz for DURABLE TARGET APPARATUS AND METHOD OF ON-TARGET VISUAL DISPLAY which issued on Jan. 22, 2013 teaches a durable target with pie shaped areas individually monitored by separate impact sensors connected to a controller. The impact sensor information is relayed to the shooter, telling him or her in which pie shaped area the hit occurred.

SUMMARY OF THE INVENTION

In accordance with the present invention, there is provided a target impact sensing system comprising, consisting of, or consisting essentially of a target with an impact sensor attached thereto, a wireless transmitter electrically connected to the impact sensor, a wireless receiver capable of receiving the wireless message with impact describing data from the transmitter and a software application for inputting data and parameters and providing an interface the transmitter and receiver. The receiver is capable of providing an impact describing audible message to a user, wherein the impact describing audible message has been interpreted from the impact describing data.

It is an object of this invention to provide an impact sensing target system which includes a small wireless impact or vibration sensor mounted on a target, with a transmitter.

It is an object of this invention to provide an impact sensing target system which includes a receiver which reports the sensor data to the shooter over headphones, ear buds or over a receiver such as an I-phone using a RF transmitter such as Bluetooth technology.

It is an object of this invention to provide an impact sensing target system wherein sensors are attached to selected areas on a vest to be worn by a paint ball competitor and wherein the impact of a paint ball or other projectile on a selected sensor causes a particular tone or other identifying signal to be transmitted to the headphones of the person who has been shot, to the person doing the shooting and others if so desired.

It is an object of this invention to provide an impact sensing target system including a plurality of individual targets of increasing size, individual sensors connected to each target, all sensors connected to a transmitter, and a receiver with headphones which identifies which target has been hit.

It is an object of this invention to provide an impact sensing target system wherein the sensor transmitter includes a small loudspeaker which creates a loud sound mimicking an exaggerated impact in the area of the target which has been hit by a projectile.

It is an object of this invention to provide an impact sensing target system wherein the projectile is actually a beam of light from a laser gun, the sensor transmitter includes a small loudspeaker which creates a loud sound mimicking an exaggerated impact in the area of the target which has been hit by the laser beam and the receiver with headphones receives a message identifying which particular target was hit.

It is another object of the present invention to provide an software app for a phone, iPO, or other receiver wherein any desired sound can be selected or recorded or downloaded to the receiver to be played for the user upon receiving the signal from the RF sensor and transmitter.

It is another object of the present invention to provide for a sensor which may be applied to a small or large target to recreate a desirable selected sound which is not dependent upon accuracy to hit the sensor only vibrations received from the sensor mounted onto a target of selected size.

It is another object of the present invention to provide an software application, transmitter, receiver, and sensor to enable the duplication of a selected rifle caliber, or provide a volume of sound in accordance with the type or gun, or distance the target is from the shooter as well as the type of material comprising the target.

It is another object of the present invention to build a counter into the software application Other objects, features, and advantages of the invention will be apparent with the following detailed description taken in conjunction with the accompanying drawings showing a preferred embodiment of the invention.

BRIEF DESCRIPTION OF THE DRAWINGS

A better understanding of the present invention will be had upon reference to the following description in conjunction with the accompanying drawings in which like numerals refer to like parts throughout the views wherein.

DESCRIPTION OF THE PREFERRED EMBODIMENTS

Figure 1:
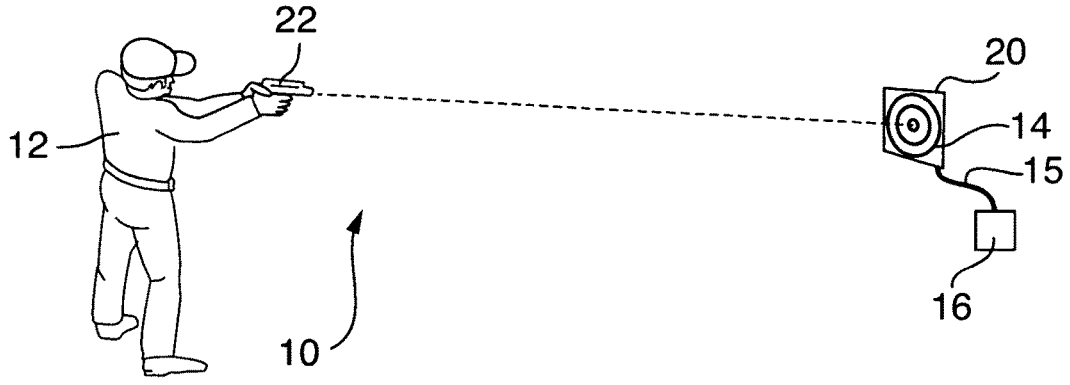
FIG. 1 is a front view of a shooter wearing a set of receiver headphones and shooting a target with an impact sensor connected to a transmitter.
Figure 4:
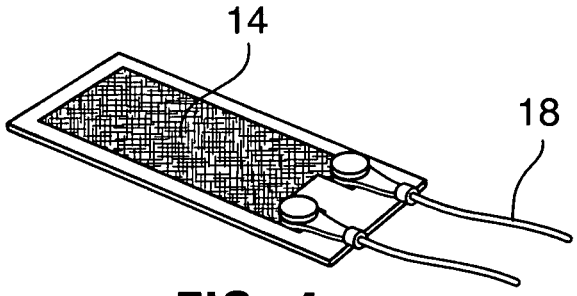
FIG. 4 is a perspective view of an impact sensor.

In accordance with the present invention, there is provided an impact sensing target system 10 which includes a impact, movement, or vibration sensor 14 such as a 3 axis accelerometer, a piezoelectric sensor, a sensor processor and transmitter 16, and a receiver 12. FIG. 1 shows a shooter 5 with a gun 22 shooting at a target 20. The target 20 has means for detecting movement and/or vibration, such as a sensor 14 attached to the front or the back of the target. The sensor 14, also shown in FIG. 4, has leads 18 connecting the sensor to a transmitter unit 16. The shooter 5 is wearing a set of headphones 12 include a receiver which receives radio frequency or infra-red transmissions from the transmitter 16.

The target is connected to at least one sensor connected to a controller which transmits a message to a receiver with a speaker to inform the shooter approximately where his hit occur. Sensor amplifier circuits, and sensor processing, transmitting, and receiving circuits as are shown in the figures. Applicant provides a target sensor system in electrical or vibration communication with the target, which merely transmits a signal to a receiver which may be worn on the shooter and on others in the general vicinity to announce that the target was hit and the intensity of the impact. The same circuitry provided in FIGS. 7 through 12 may be used in the applicant's invention. A preferred embodiment uses a Bluetooth transmitter and a cell phone as a receiver.

The sensor 14 includes circuitry which senses slight impact or vibrations and converts them into an electrical voltage which the transmitter converts into a message which is sent to the receiver. The message is an audible signal which may sound like projectile hitting something or the signal can be a voice explaining that a target has been hit or identifying which target has been hit in the case of multiple targets, as shown in FIG. 3.

Figure 3:
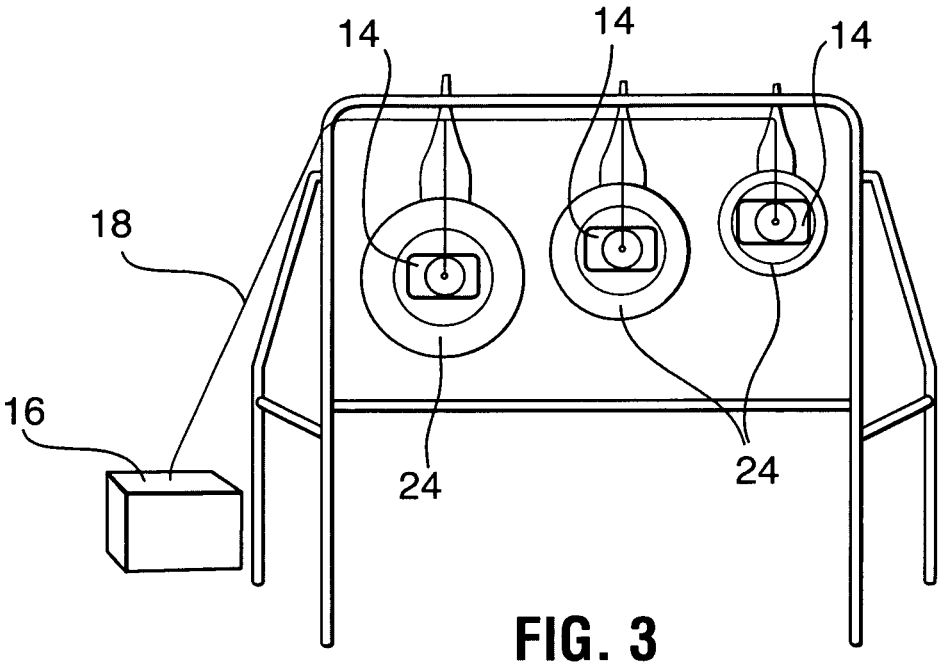
FIG. 3 is a front view of a target including three targets of different sizes, each with it's own sensor and where all the sensors are connected to a transmitter.

FIG. 3 shows a group of targets of varying sizes. The targets 24 each have a separate sensor 14 with leads 18 connected each sensor 14 to the transmitter 16. The transmitter 16 will relay a message to the shooter's receiver as to which target has been struck. The message may include information as to the degree of impact, in other words, a more direct or 'centered' hit will be reported by a louder message in the headphones or perhaps by a numerical score.

Figure 5:
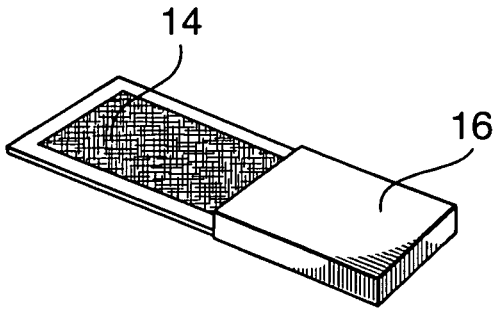
FIG. 5 is a perspective view of a one piece sensor 14 and transmitter 16.
Figure 6:
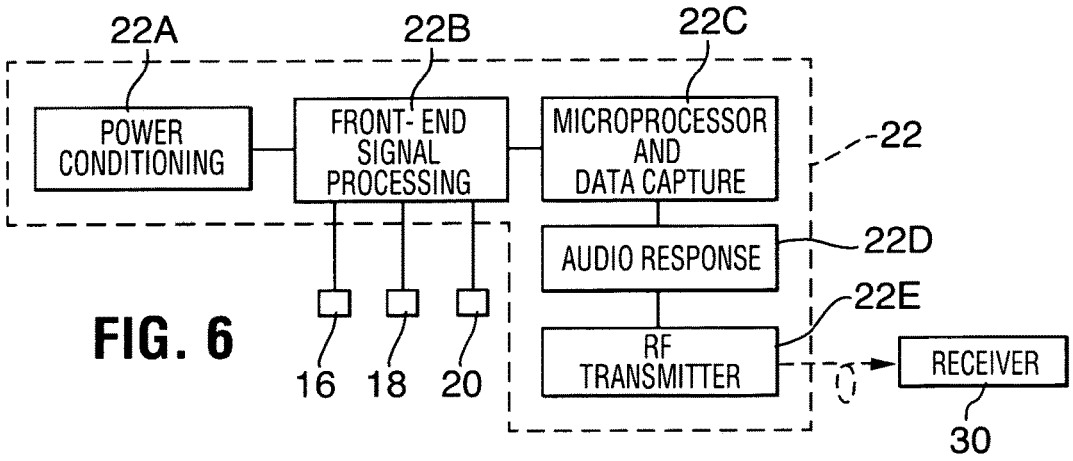
FIG. 6 is a block diagram of a sensor system including sensors 16-20, a processor and transmitter unit and a receiver unit.
Figure 7:
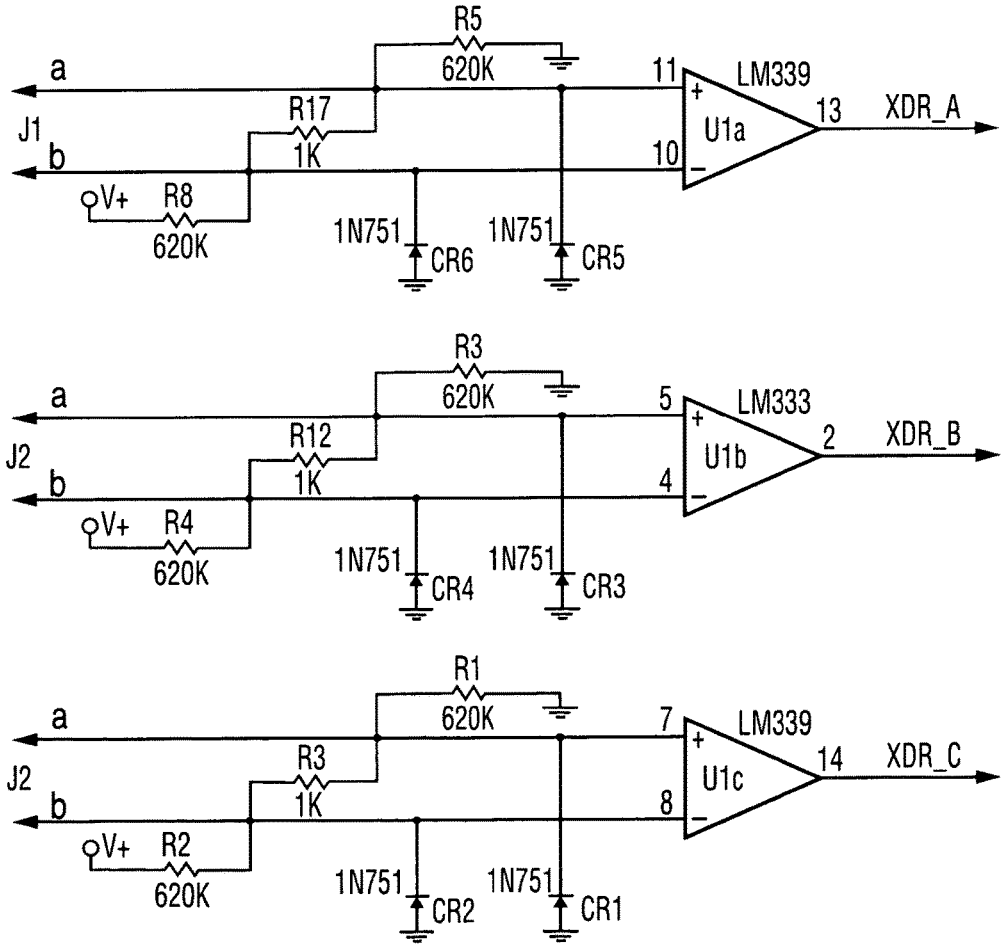
FIG. 7 shows a circuit diagram for exemplary sensor conditioning circuits for three sensors.
Figure 8:
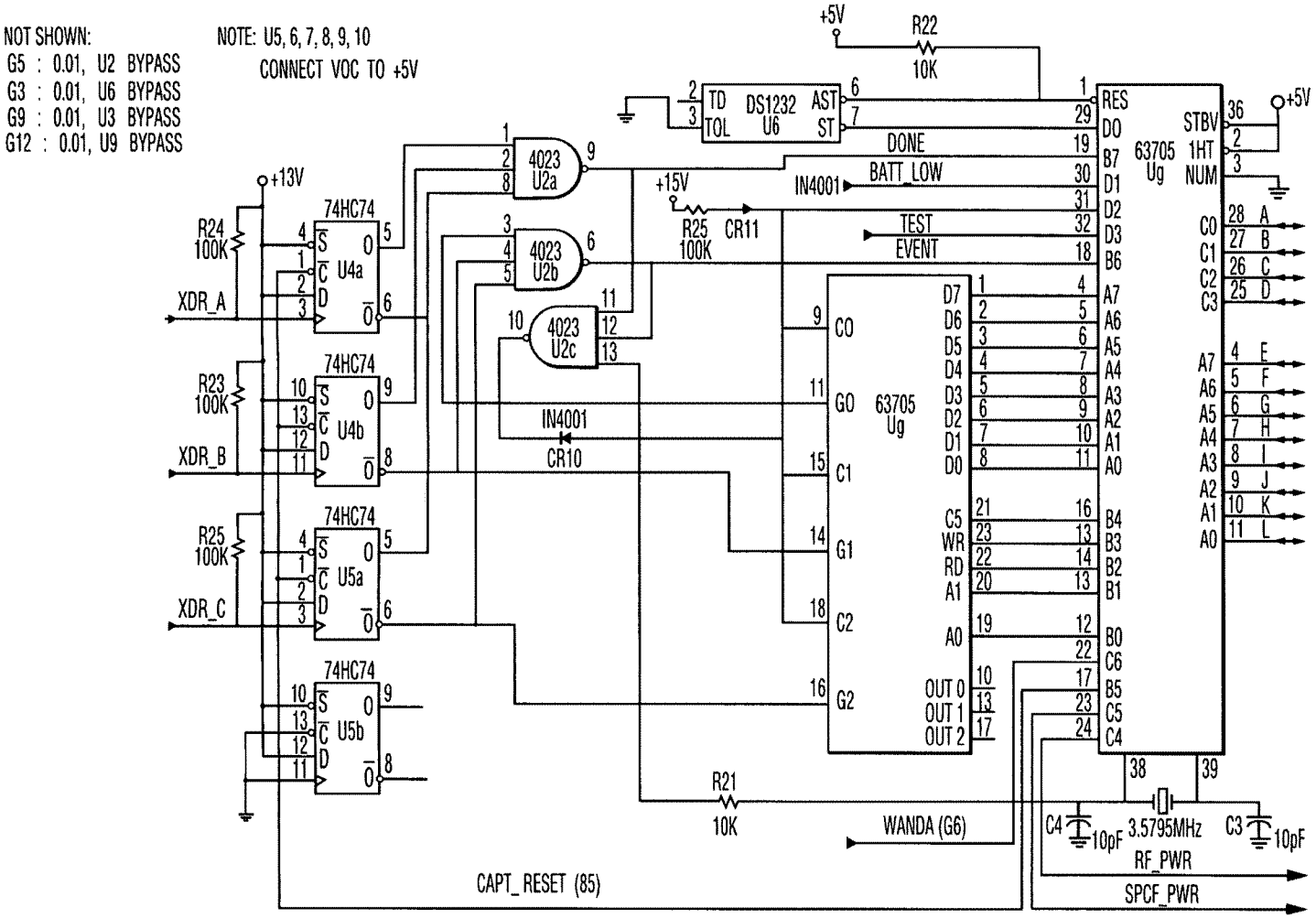
FIGS. 8, 9 and 10 show circuit diagrams for exemplary sensor signal processing and transmitting.
Figure 9:
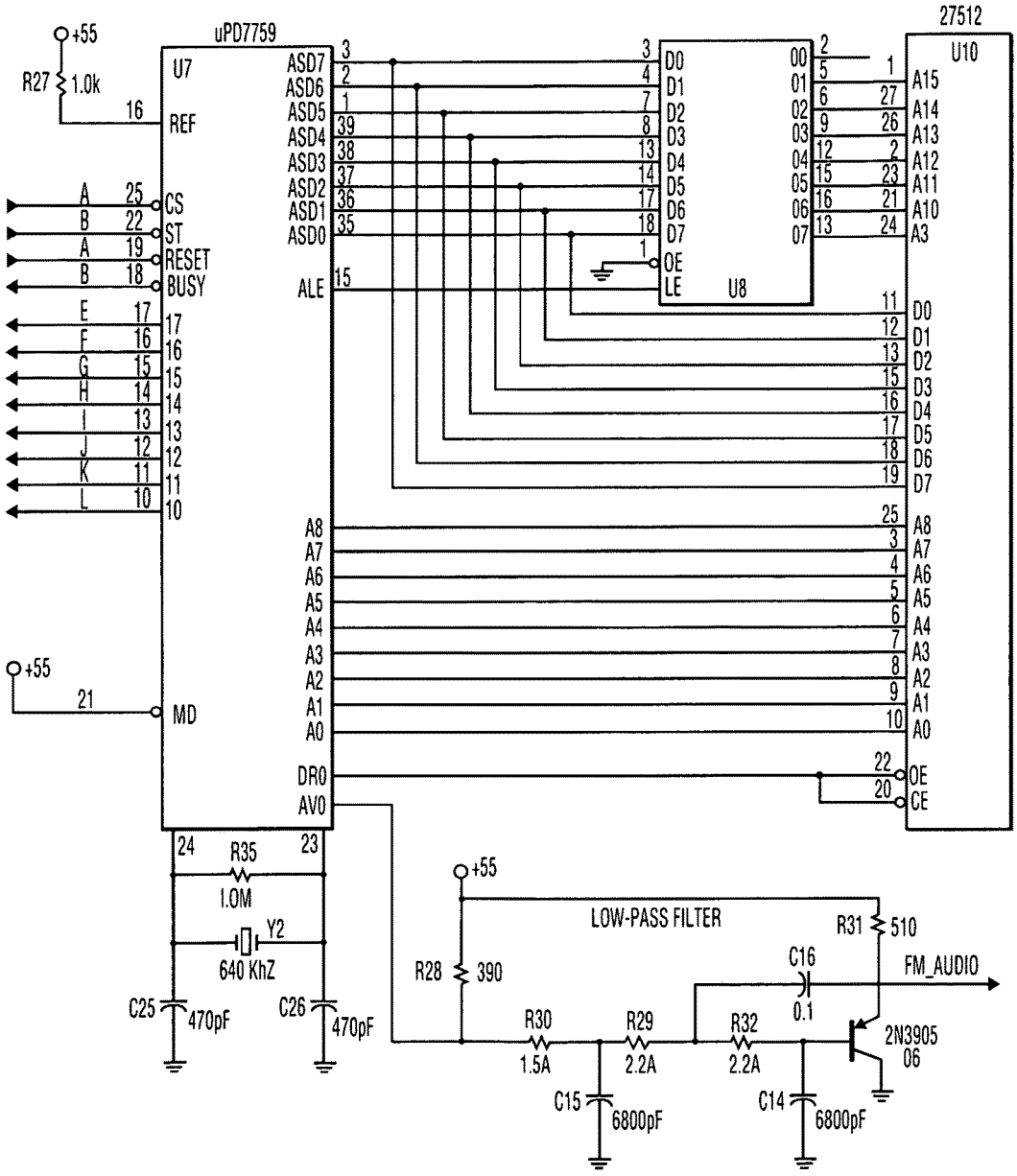
Figure 10:
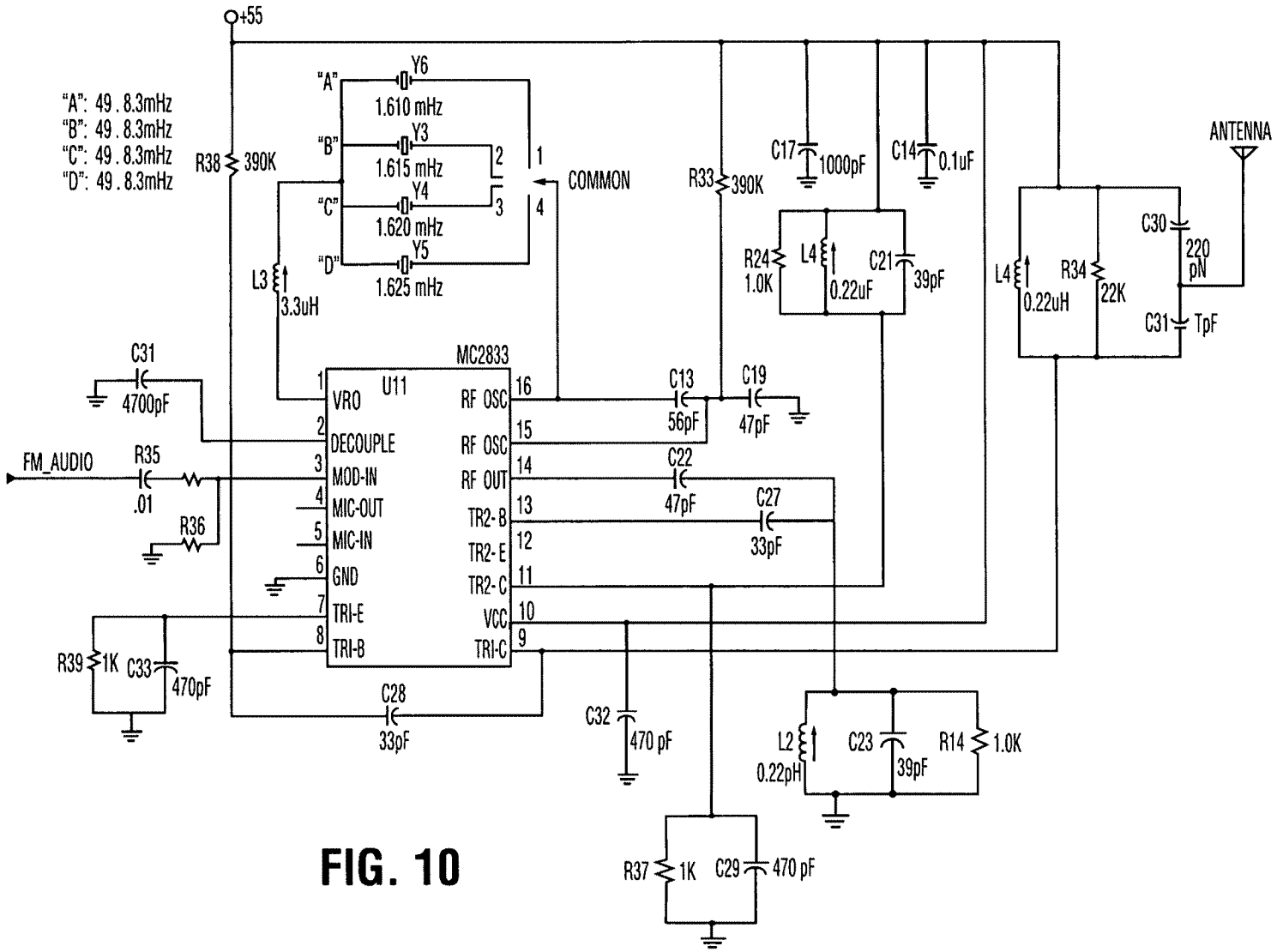
Figure 11:
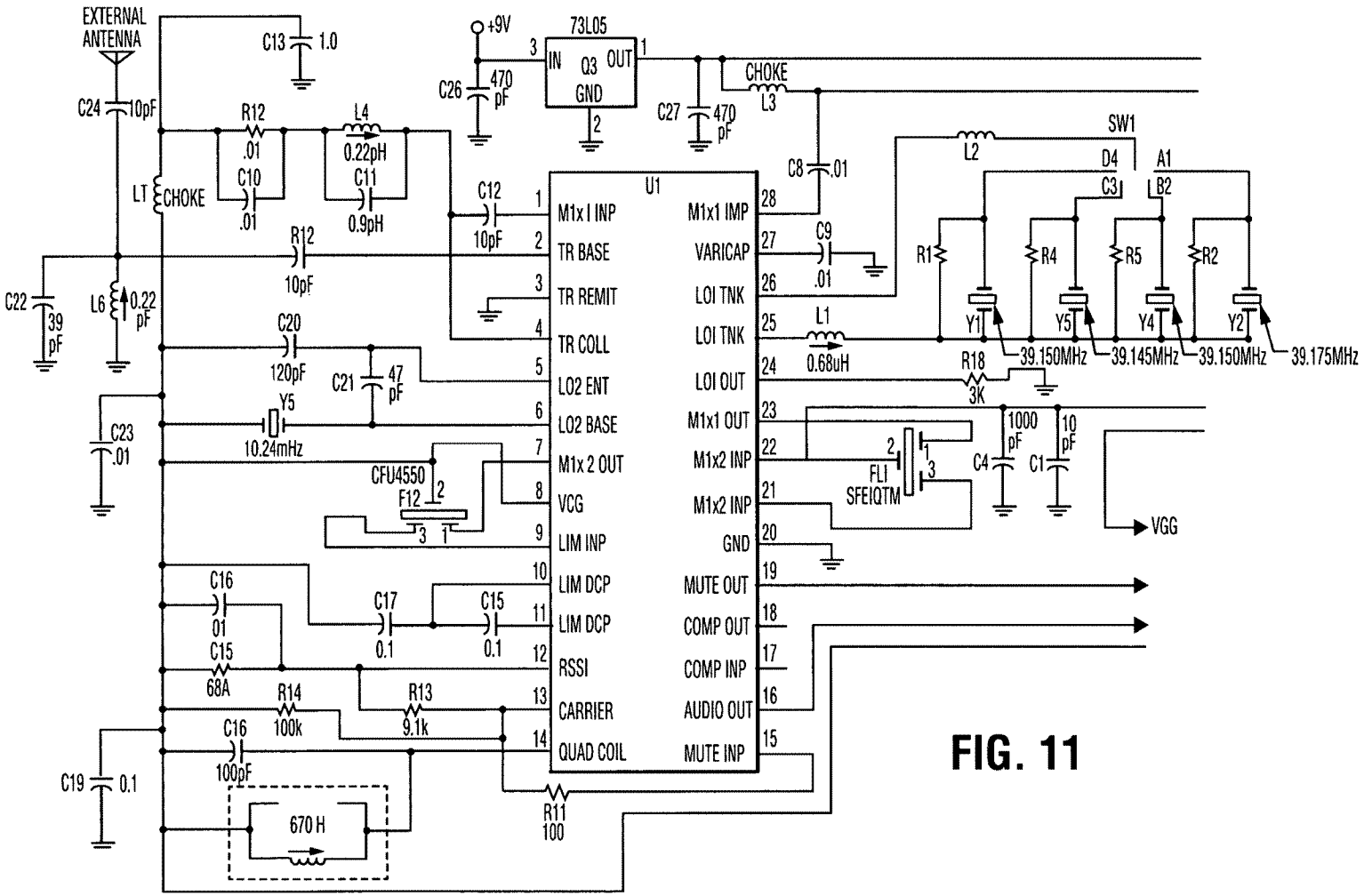
FIG. 11 is a circuit diagram for an exemplary receiver circuit.
Figure 12:
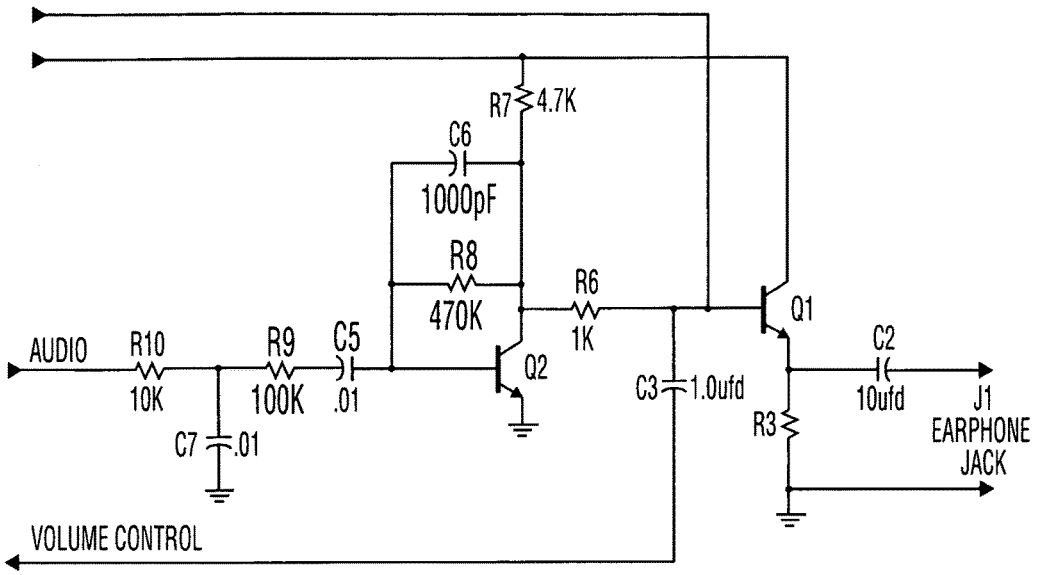
FIG. 12 is a circuit diagram for an audio amplifier.

In another embodiment of the present invention, the sensor 14 and the transmitter 16 are incorporated into one small package as shown in FIG. 5. Because the sensor/transmitter of FIG. 5 is so small and still self-contained, the sensor can be easily applied to various targets and even re-used on other targets. The sensor/transmitter is therefore easily portable as well.

Other embodiments of the target sensor system 10 use Bluetooth technology, which transmits messages using a selected frequency such as 2.45 Ghz carrier with a low power signal on the order of a few milliwatts. The receiver is a Bluetooth ready I-phone or other radio frequency transmission, which may include headphones or ear buds, and includes the application software enabling the I-phone to relay target pertinent messages. Amplifiers are available to increase the range of the Bluetooth sensors, if needed.

Additionally, the receiver 12 which the player who has been shot is wearing may include a small loudspeaker which gives a loud sound when that player is shot, as well.

It is understood that the transmitters and receivers discussed above communicate wirelessly and are preferably powered by batteries contained in the transmitter and in the receiver. However, in some cases, power delivered by wire, such as house current, is acceptable where desired. The impact sensor 14 is a piezoelectric type sensor, but may be electromagnetic, capacitive, inductive or any other type of impact, motion or vibration sensor which will provide a detectible impact signal.

Figure 2:
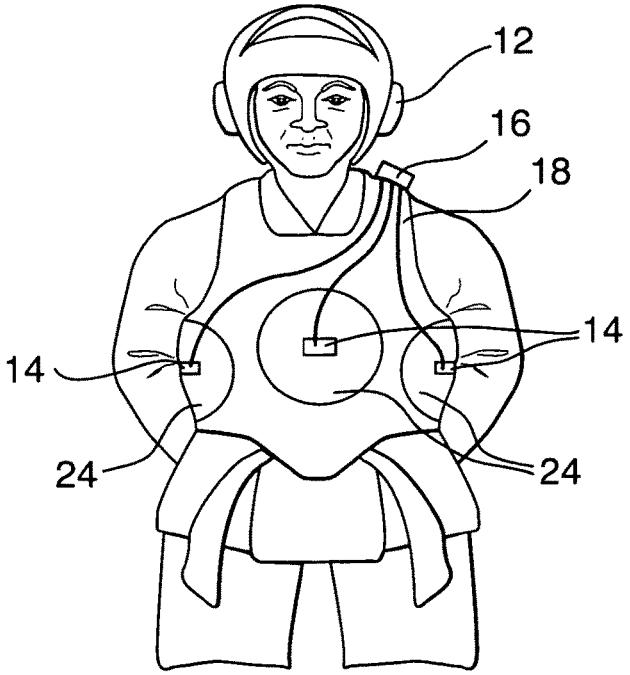
FIG. 2 is a front view of a paint ball competitor wearing a vest containing impact sensor pads with sensors connected to a transmitter.

Another example of use of the present invention is shown in FIG. 2 is used in paint ball sports and in laser tag sports, as well. Each player wears a garment with targets on selected areas of the body such as the chest, the back, and on each side of the chest. Pads 24 on the garment have sensors 14 attached inside the pads which sense when the pad has been hit with a paint ball or pellet, or in the case of laser tag, with a laser beam. The sensors 14 are connected to the transmitter 16 on the players shoulder. The transmitter transmits a message to the shooter's receiver/headphone 12, to the headphone of the player who has been shot, and if desired, to other player's headphones as well. The message includes information identifying the player who was shot, which target on the player was hit and other data as desired.

The foregoing detailed description is given primarily for clearness of understanding and no unnecessary limitations are to be understood therefrom, for modification will become obvious to those skilled in the art upon reading this disclosure and may be made without departing from the spirit of the invention and scope of the appended claims. Accordingly, this invention is not intended to be limited by the specific exemplification presented herein above. Rather, what is intended to be covered is within the spirit and scope of the appended claims.

The invention claimed is:

1. A target impact sensing system consisting of:

a device for shooting projectiles;

a shooting target sensing an impact of a projectile selected from the group consisting of a metallic target, a paper target, a target worn on by a paint ball player, and combinations thereof with an impact sensor selected from the group consisting of a piezoelectric sensor, an electromagnetic sensor, a 3 axis accelerometer, a capacitive sensor, and an inductive sensor;

a wireless transmitter electrically connected to said impact sensor, said wireless transmitter transmitting a wireless message selected from the group consisting of radio frequency transmissions and infra-red transmission with impact describing data;

said wireless transmitter transmitting a pre-selected sound to a receiver upon said projectile impacting said target said wireless transmitter using BLUETOOTH format and said receiver includes a radio frequency transmitter and RF receiver with application software enabling a cell phone to receive an audible transmission from said wireless transmitter;

a receiver capable of receiving said wireless message with impact describing data from said wireless transmitter and capable of providing an impact describing audible message to a user, said impact describing audible message being interpreted from said impact describing data;

an audible sound selected from the group of sounds consisting of a sound produced from firing a selected gun, a sound which is indicative of a distance the impact is from the center of said target, a sound which mimics an impact of a hit on a selected material comprising the target, a sound mimicking an exaggerated impact, a sound which is indicative of a distance said target is from a shooter, and combinations thereof.

2. A target impact sensing system consisting of:

a laser device for projecting a laser beam;

a shooting target for sensing an impact of a said laser beam on said target selected from the group consisting of a stationary target, a target worn on a player, and combinations thereof with a sensor selected from the group consisting of a piezoelectric sensor, an electromagnetic sensor, a 3 axis accelerometer, a capacitive sensor, and an inductive sensor;

a wireless transmitter electrically connected to said impact sensor, said wireless transmitter capable of transmitting a wireless message selected from the group consisting of radio frequency transmissions and infra-red transmission with impact describing data;

said wireless transmitter transmitting a pre-selected sound to a receiver upon said projectile impacting striking said target;

a receiver capable of receiving said wireless message with impact describing data from said wireless transmitter and capable of providing an audible message to a user, said audible message including data consisting of a target identification and a degree of accuracy;

said receiver and said wireless transmitter use BLUETOOTH format and said receiver includes a radio frequency transmitter and RF receiver with application software enabling a smart phone to provide audible messages containing target strike data; and an audible message comprising a first pre-selected sound transmitted to said receiver upon firing a laser device projecting a laser beam and a second pre-selected sound mimicking an impact of a hit of said laser beam on a selected target.

3. A target impact sensing system consisting of:

a device for shooting projectiles;

a shooting target for sensing an impact of a projectile on a target worn on by a paint ball player with an impact sensor selected from the group consisting of a piezoelectric sensor, an electromagnetic sensor, a 3 axis accelerometer, a capacitive sensor, and an inductive sensor, said impact sensor attaching to a selected areas on an article of clothing worn by said paint ball player;

a wireless transmitter electrically connected to said impact sensor, said wireless transmitter capable of transmitting a wireless message selected from the group consisting of a radio frequency transmissions and a infra-red transmission with impact describing data;

said wireless transmitter transmitting a pre-selected sound to a receiver upon said projectile impacting said target;

said receiver capable of receiving said wireless message with impact describing data from said wireless transmitter and capable of providing an impact describing audible message to a paint ball player said receiver and said wireless transmitter use BLUETOOTH format and said receiver includes a radio frequency transmitter and RF receiver with application software enabling a smart phone to provide audible messages containing target impact data;

said impact of said projectile on said impact sensor transmitting a selected sound to said receiver of said paint ball player wearing said impact sensor and said paint ball player shooting said projectile;

said audible message consisting of a first pre-selected sound mimicking a selected exaggerated impact sound produced from firing a selected device for shooting projectiles and a second pre-selected sound mimicking an exaggerated impact, and combinations thereof.

* * * * *